US008146528B2

(12) United States Patent
Fralick

(10) Patent No.: US 8,146,528 B2
(45) Date of Patent: Apr. 3, 2012

(54) MANUAL PRESCRIPTION USE RECORDING DEVICE

(76) Inventor: James Frederick Fralick, Antelope, CA (US)

( * ) Notice: Subject to any disclaimer, the term of this patent is extended or adjusted under 35 U.S.C. 154(b) by 371 days.

(21) Appl. No.: 12/491,212

(22) Filed: Sep. 4, 2009

(65) Prior Publication Data

US 2011/0056426 A1 Mar. 10, 2011

(51) Int. Cl.
*A61J 7/04* (2006.01)
*G09F 11/00* (2006.01)
*G09F 9/00* (2006.01)

(52) U.S. Cl. ..... 116/316; 116/308

(58) Field of Classification Search ..... 116/308, 116/309, 311–321, 323, 324; 206/459.1, 206/534, 459.5; 215/230
See application file for complete search history.

(56) References Cited

U.S. PATENT DOCUMENTS

| | | | | | |
|---|---|---|---|---|---|
| 332,208 | A | * | 12/1885 | Noel | 116/308 |
| 1,912,418 | A | * | 6/1933 | McCreary et al. | 116/307 |
| 1,992,028 | A | * | 2/1935 | Harper | 40/666 |
| 3,911,856 | A | * | 10/1975 | Ewing | 206/534 |
| 4,308,678 | A | * | 1/1982 | Slobin | 40/113 |
| 4,528,933 | A | * | 7/1985 | Allen | 116/308 |
| 4,886,010 | A | * | 12/1989 | Stutzman | 116/308 |
| 4,920,912 | A | * | 5/1990 | Kirkling | 116/308 |
| 5,299,701 | A | * | 4/1994 | Barker et al. | 215/230 |
| 5,377,614 | A | * | 1/1995 | Glazer | 116/308 |
| 5,386,795 | A | * | 2/1995 | Bartholomew | 116/308 |
| 5,433,324 | A | * | 7/1995 | Leonard | 206/534 |
| 6,000,159 | A | * | 12/1999 | Hornung | 40/307 |
| 6,068,149 | A | * | 5/2000 | Telega | 215/230 |
| 6,789,497 | B1 | * | 9/2004 | Aiken | 116/308 |
| D501,755 | S | * | 2/2005 | Namur | D7/397 |
| 7,017,762 | B2 | * | 3/2006 | Shane | 215/230 |
| 7,621,273 | B2 | * | 11/2009 | Morton et al. | 128/205.23 |
| 7,661,384 | B2 | * | 2/2010 | Mataya | 116/311 |
| 7,857,134 | B2 | * | 12/2010 | Koch | 206/534 |
| 2006/0124501 | A1 | * | 6/2006 | McNeely | 206/534 |
| 2007/0187282 | A1 | * | 8/2007 | Seijas | 206/534 |

FOREIGN PATENT DOCUMENTS

FR 2788932 A1 * 8/2000

* cited by examiner

*Primary Examiner* — R. A. Smith
(74) *Attorney, Agent, or Firm* — Marcus Risso; Risso & Associates

(57) ABSTRACT

Described is manual prescription use recording device. The device includes a lid for connection with a prescription container. A slider is rotatably connected with the lid such that the slider is rotatable in the X-axis around the lid to reveal markings that are indicative of at least one of a time and date. A second slider can also be included to reveal additional time and date markings. Finally, a thumb wheel can be included that is rotatable in the Y-axis to reveal additional markings. Protrusions and corresponding deviations are included in the lid and sliders so that they can be maintained in a desired position. Thus, the present invention allows a user to log the time and date the medication was last taken by using rotary dials placed on or in the lid of the prescription bottle.

3 Claims, 15 Drawing Sheets

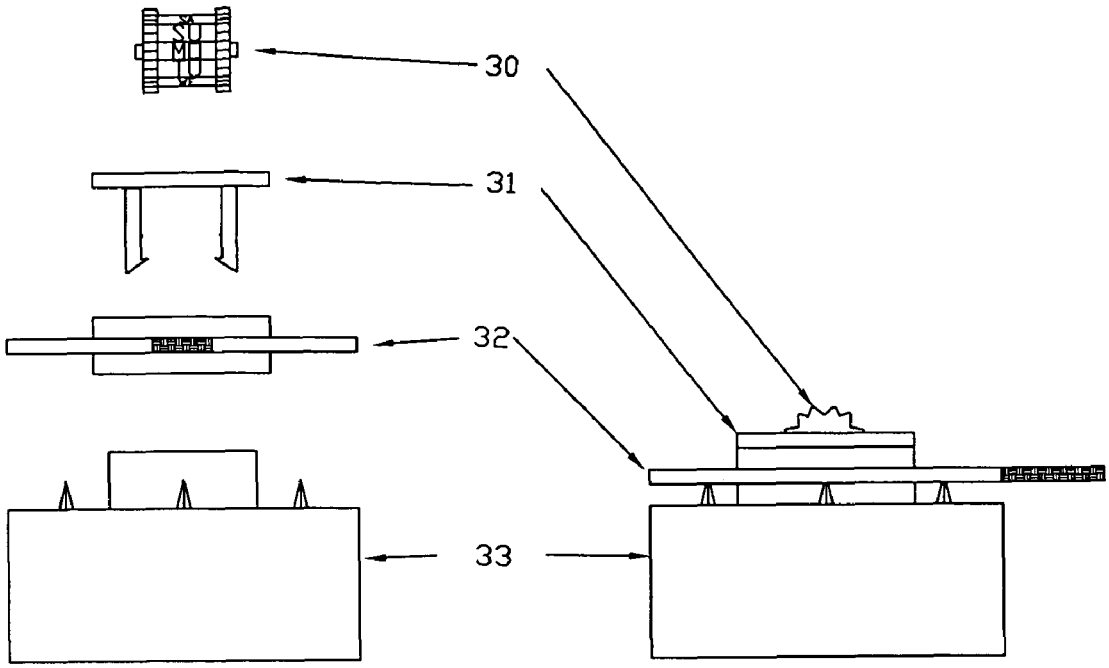
FIGURE 3A
FIGURE 3B
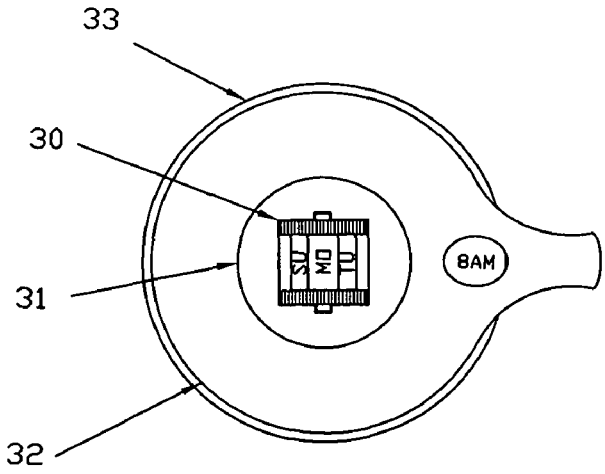
FIGURE 3C

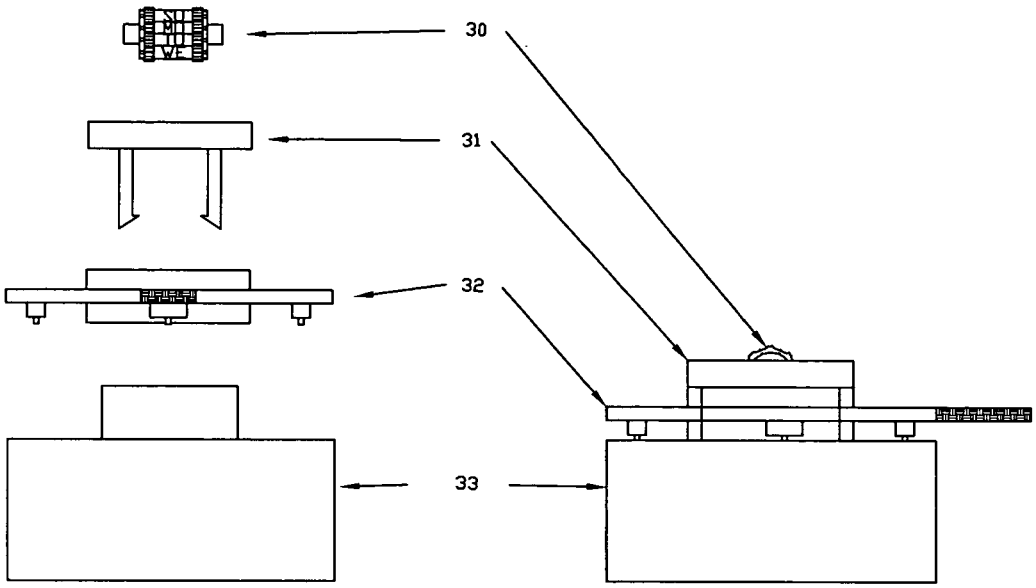
FIGURE 5A
FIGURE 5B
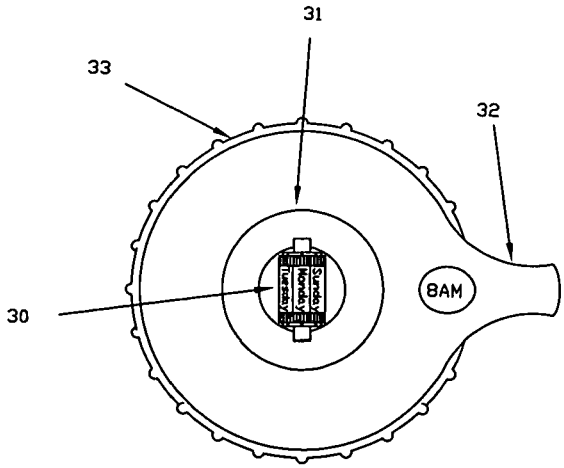
FIGURE 5C

Figure #
Column 1
Column 2
Column 3
Column 4

30-A1
30-A2
30-A3
30-A4

30-B1
30-B2
30-B3
30-B4

30-C1
30-C2
30-C3
30-C4

30-D1
30-D2
30-D3
AM
30-D4

30-E1
30-E2
30-E3
30-E4

30-F1
30-F2
30-F3
30-F4

30-G2
30-G2
30-G3
30-G4

30-H1
30-H2
30-H3
30-H4
COLUMN 1
COLUMN 2
COLUMN 3
COLUMN 4

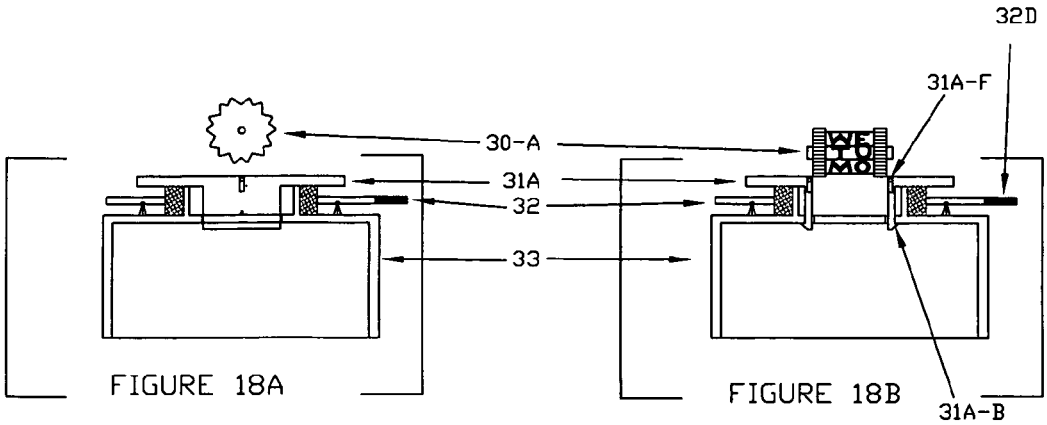
FIGURE 18A
FIGURE 18B
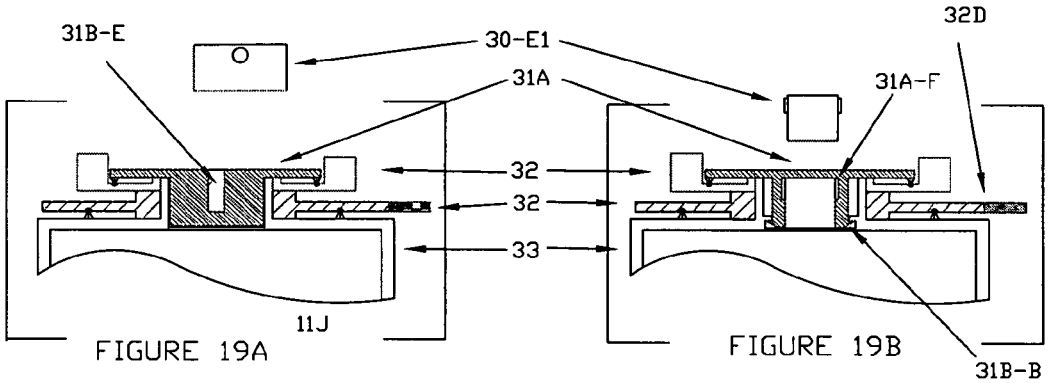
FIGURE 19A
FIGURE 19B
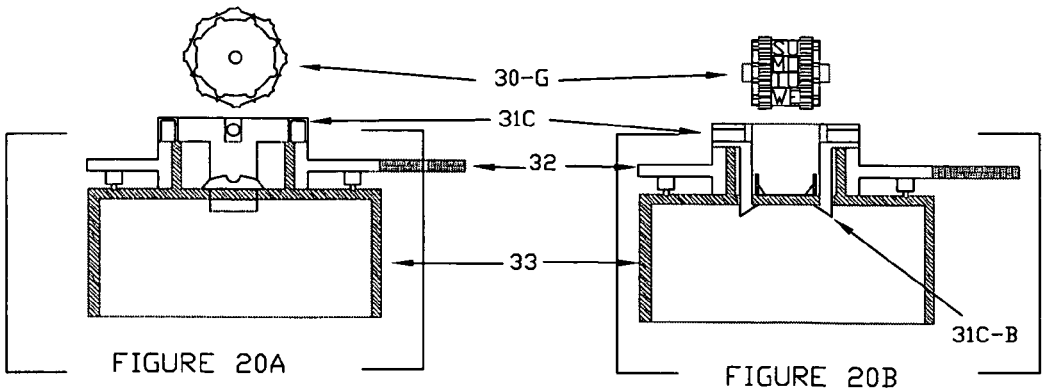
FIGURE 20A
FIGURE 20B

MANUAL PRESCRIPTION USE RECORDING DEVICE

BACKGROUND OF THE INVENTION (1) Field of Invention

The present invention relates to prescription monitoring device and, more specifically, to a method and device for manually recording materials taken from a container.

(2) Description of Related Art

Containers have been made in the past to aid patients in maintaining daily dosages; however, the recording of the time or frequency typically required additional judgment by the medication recipient. Therapeutic levels of medications are required when the patient is least able to accurately self medicate.

Historically, an individual's memory and/or logs were the primary recording devices used in determining when medications were taken last. Other devices used for dispensing a patient's daily regimen required re-packaging the medication. Repackaging was an improvement in that the materials were re-dispensed in order to isolate the material in specific quantities. The problems with such methods are that:

They require multiple containers for medication use multiple times of day and still requiring mental acuteness of the patient;

They require a patient to refill the containers on a frequent basis;

Using a separate container removes labeling that provides vital information concerning the medication; and They require maintaining a log independent of the container to record dispensing.

Dispensing materials or substances improperly could cause or be an indication of:

Drug overdose; and

Ineffective or non-therapeutic dose of Medication.

Thus, a continuing need exists for a prescription use recording device that maintains a log of usage in conjunction with a single container.

SUMMARY OF INVENTION

The present invention relates to a manual prescription use recording device. As noted above, a deficit in the prior art of prescription use recording devices is that they typically require separate recording logs and/or containers. The present invention improves upon the prior art by allowing a user to simply log the time and date the medication was last taken by using rotary dials placed on or in the lid of the prescription bottle. Maintaining the record on the container lid allows for the original label to remain on the container with the medication. By using the lid as the recorder, this information is presented each and every time the container is opened as a reminder to the user or patient.

The arrangement of the manual prescription use recording device is flexible in order to allow for a multitude of time frequencies that may be necessary to record. As a non-limiting example, from one to three sources of information may be recorded by the device.

In general, the device comprises a lid for connection with a prescription container and a slider rotatably connected with the lid. The slider is rotatable around the lid to reveal markings that are indicative of at least one of a time and date. A second slider can also be rotatably connected with the lid to reveal additional markings that are indicative of at least one of a time and date. In another aspect, a thumb wheel is rotatably attached with the lid such that the thumb wheel can be rotated to reveal time and/or date markings. The sliders are rotatable on an X-axis while the thumb wheel is rotatable on a Y-axis. Additionally, protrusions and corresponding deviations are formed in at least one of the lid and slider to maintain the slider in a desired position.

An advantage provided by the present invention is that the original containers are re-used and/or maintained. Information, such as the containers contents and the intended dispensing instructions, may be left fully intact for future reference.

BRIEF DESCRIPTION OF THE DRAWINGS

The objects, features and advantages of the present invention will be apparent from the following detailed descriptions of the various aspects of the invention in conjunction with reference to the following drawings, where:

FIG. 3A is an exploded, front-view illustration of the device depicted in FIG. 1;

FIG. 3B is side-view illustration of the device depicted in FIG. 1;

FIG. 3C is a top-view illustration of the device depicted in FIG. 1;

FIG. 5A is an exploded, front-view illustration of a modified container lid illustrating components of a manual prescription use recording device according to the present invention;

FIG. 5B is side-view illustration of the device depicted in FIG. 5A;

FIG. 5C is a top-view illustration of the device depicted in FIG. 5A;

FIG. 18A is an internal, side-view illustration, depicting the components of the manual prescription use recording device being combined to form a complete unit;

FIG. 18B is an internal, front-view illustration, depicting the components of another design of the manual prescription use recording device being combined to form a complete unit;

FIG. 19A is an internal, side-view illustration, depicting the components of another design of the manual prescription use recording device being combined to form a complete unit;

FIG. 19B is an internal, front-view illustration, depicting the components of another design of the manual prescription use recording device being combined to form a complete unit;

FIG. 20A is an internal, side-view illustration, depicting the components of another design of the manual prescription use recording device being combined to form a complete unit; and FIG. 20B is an internal, front-view illustration, depicting the components of another design of the manual prescription use recording device being combined to form a complete unit.

DETAILED DESCRIPTION

Figure 1:
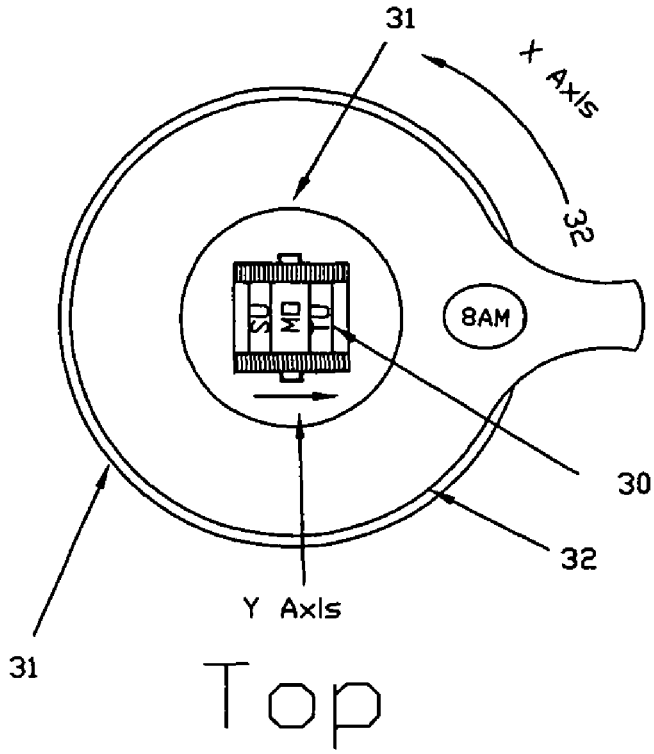
FIG. 1 is a top-view illustration of a modified container lid illustrating components of a manual prescription use recording device according to the present invention.

The present invention relates to prescription monitoring device and, more specifically, to a method and device for manually recording materials taken from a container. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

As noted above, the present invention is a manual prescription use recording device. The present invention improves upon the prior art by allowing a user to simply log the time and date the medication was last taken by using a marking device (e.g., rotary dials) placed on or in the lid of the prescription bottle. Maintaining the record on the container lid allows for the original label to remain on the container with the medication. By using the lid as the recorder, this information is presented each and every time the container is opened as a reminder to the user or patient.

Provided herein are several non-limiting examples of how such a device can be achieved. As a central resource for the reader, it should be understood that several dominant components of the present invention are:

Thumb wheel (30);

Retaining clip (31);

Slider (32); and

Modified lid or cap (33).

FIG. 1 provides a top-view illustration of the recording device, depicting an arrangement that can record up to two categories of time. In this non-limiting example, time and day are provided. By turning the slider 32 on the "X" axis, and turning the thumb wheel 30 on the "Y" axis, a time and day can be recorded respectively. The parameters of what is recorded are meant to coincide with the prescription initiated by a physician. These parameters present a large variety of options resulting in the large variety of configurations provided herein.

Figure 2:
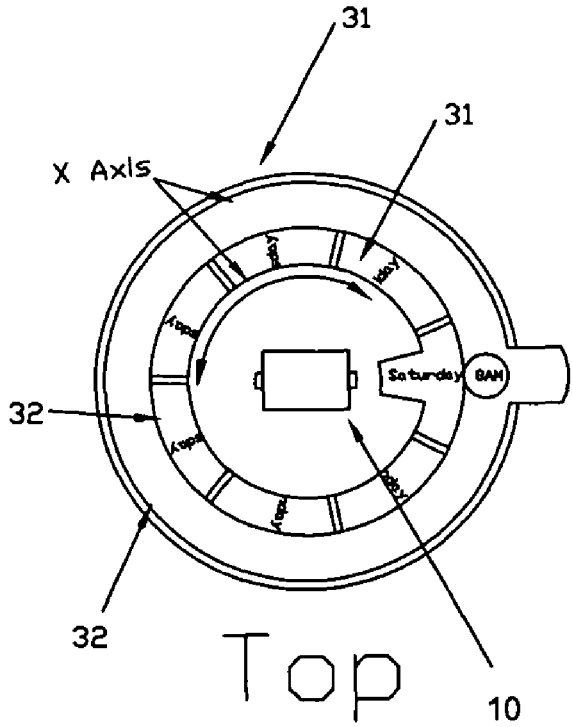
FIG. 2 is a top-view illustration of a modified container lid illustrating components of a manual prescription use recording device according to the present invention.

FIG. 2 provides a top-view illustration of the recording device, depicting an arrangement that can record up to three categories of time. In this specific model, time and day are the examples, as the third option (i.e., where a thumb wheel could be positioned) has been replaced with a plug 10. By turning one of the sliders 32 on the "X" axis the day is changed, and another slider 32 (i.e., second slider) the time is changed. The parameters of what is recorded are meant to coincide with the prescription initiated by a physician. The parameters that can be recorded in this option are more expansive than the first option.

FIGS. 3A and 3B provide an exploded front-view, and assembled side-view, respectively, of the device depicted in FIG. 1. The base structure (i.e., modified lid or cap (33)) holds the slider 32 in place with the assistance of the retaining clip 31. Once the retaining clip 31 is pressed into the lid 33, the slider 32 is now functional. A thumb wheel 30 (or other suitably rotatable device) may be installed either before or after this installation is complete. The thumb wheel 30 is to be installed on the top of the device and secured by means commonly known by those in the mechanical arts. Once installed, the final device arrangement is now fully operational and resembles the depiction in FIGS. 3B and 3C (which provides the top-view illustration).

Figure 4A:
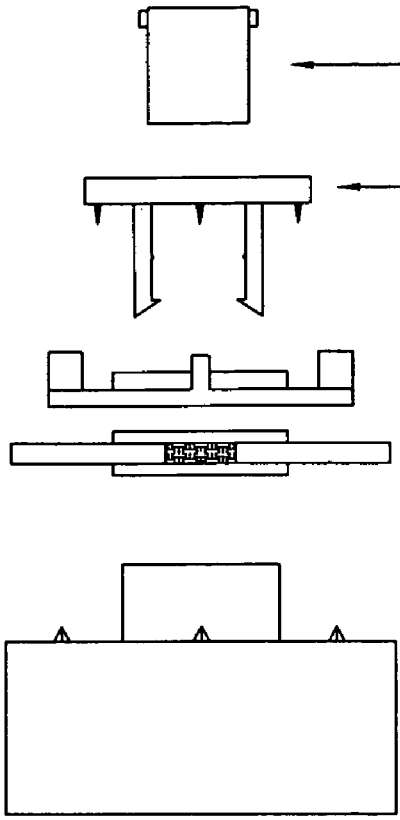
FIG. 4A is an exploded, front-view illustration of the device depicted in FIG. 2.
Figure 4B:
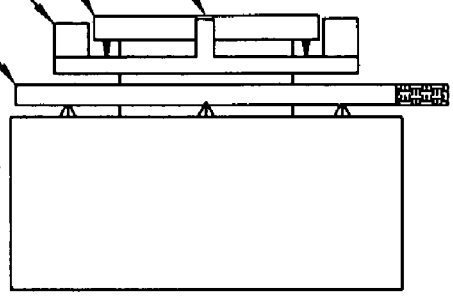
FIG. 4B is side-view illustration of the device depicted in FIG. 2.
Figure 4C:
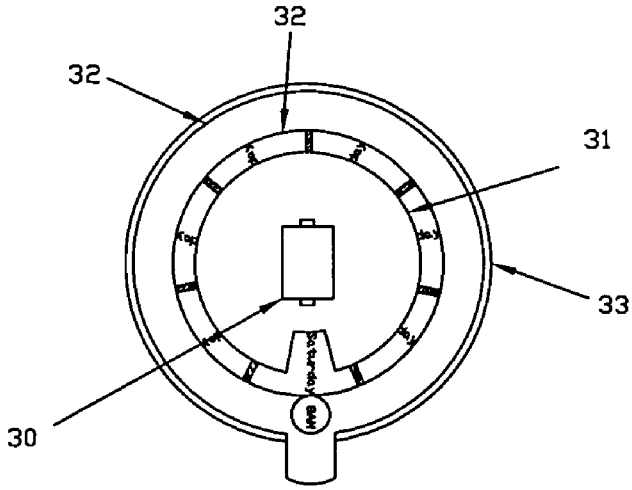
FIG. 4C is a top-view illustration of the device depicted in FIG. 2.
Figures 6A, 6B, 6C, 6D, 6E, 6F, 6G, 6H:
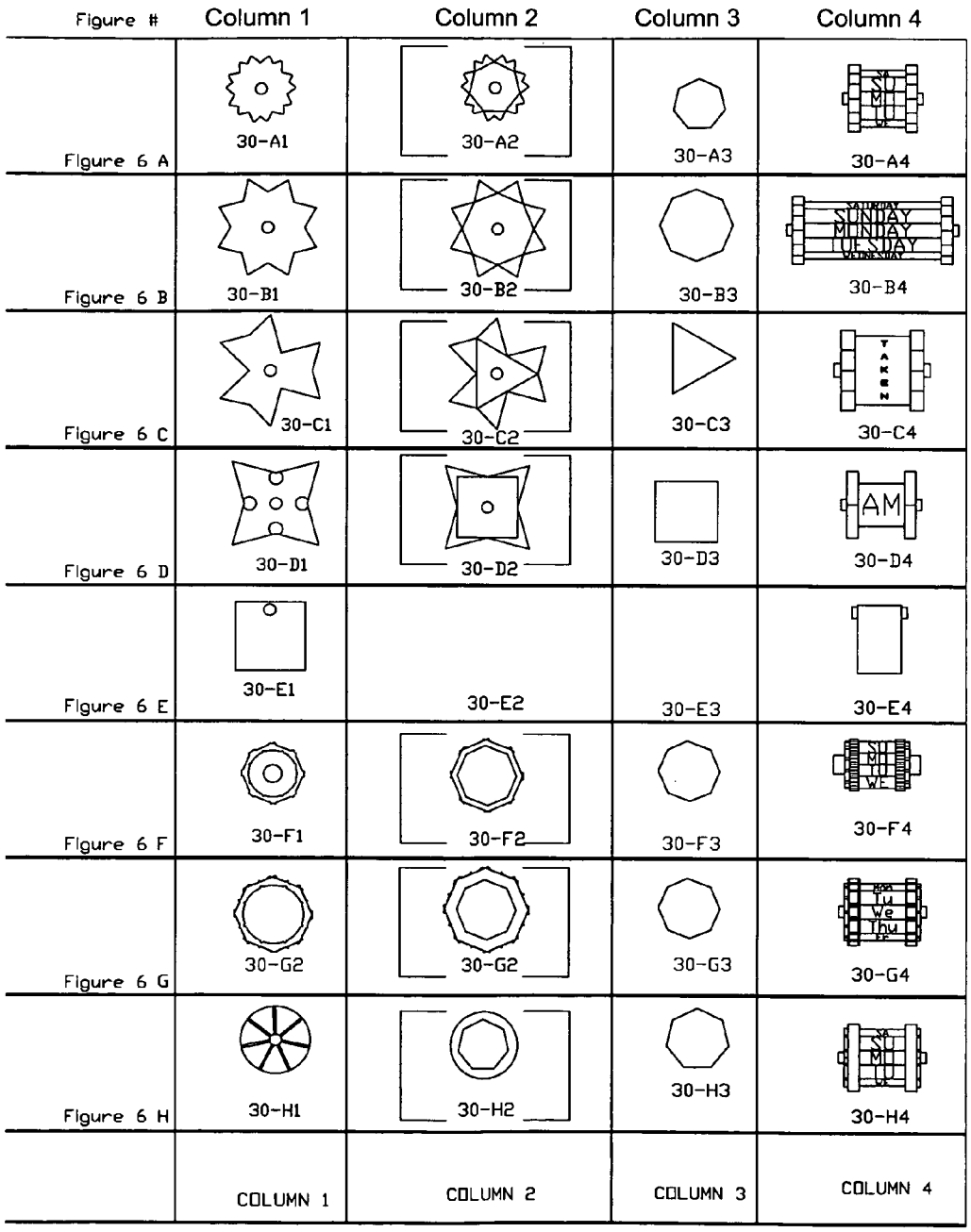
FIG. 6A thru FIG. 6H illustrate a thumb wheel and various perspective views of the thumb wheel designs as used and depicted throughout the figures described herein.

FIGS. 4A and 4B provide an exploded front-view, and assembled side-view, respectively, of the device depicted in FIG. 3. The base structure 33 holds moving parts 32 in place with the assistance of the retaining clip 31. Once the retaining clip 31 is pressed into lid 33, the sliders 32 are now functional. The thumb wheel 30 may be installed either before or after this installation is complete. The thumb wheel 30 is to be installed on the top of the device and secured by means commonly known by those in the mechanical arts. This specific configuration depicts the ability for the designer, when not requiring the third option of duration recording, to incorporate the plug 10 into the retaining clip 31 as a single unit and simplifying this configuration by means commonly known by those in the mechanical arts. Once installed, the final device arrangement is now fully operational and resembles the depiction in FIGS. 4B and 4C (which provides the top-view illustration).

FIGS. 5A and 5B provide an exploded front-view, and assembled side-view, respectively, of a device similar to that depicted in FIG. 1. The lid 33 holds moving part (i.e., slider 32) in place with the assistance of the retaining clip 31. Once the retaining clip 31 is pressed into the lid 33, the slider 32 is now functional. The thumb wheel 30 may be installed either before or after this installation is complete. The thumb wheel 30 is to be installed on the top of the device and secured by means commonly known by those in the mechanical arts. Once installed, the final device arrangement is now fully operational and resembles the depiction in FIGS. 5B and 5C (which provides the top-view illustration).

FIGS. 6A thru 6H provide examples of possible configurations of the uppermost wheel (i.e., thumb wheel 30) in numerous configurations. These configurations simply allow the designer to provide options for the user to record pertinent information. What is pertinent to one user may not be applicable to another; therefore, various options are required. Means and methods for the functionality for the thumb wheel 30 are restricted only to the ability of the user to turn the wheel with hand or finger pressure. Multiple means and methods are provided in examples to clearly explain the flexibility of the design. Column 1 provides a side-view of the thumb wheel 30 which, in many cases, provides the friction or restriction point that secures the item in place for viewing. Column 2 provides an exploded view, internal to the thumb wheel 30, indicating the relationship of the surfaces. Column 3 provides a side-view sample of options for writing surfaces available to the designer. Finally, column 4 provides samples of the viewing surfaces of the thumb wheel 30.

Figure 7:
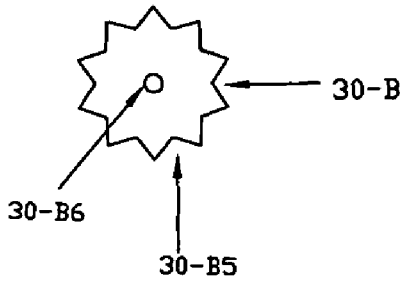
FIG. 7 is an illustration of a thumb wheel according to the present invention, depicting a particular design option.
Figure 8:
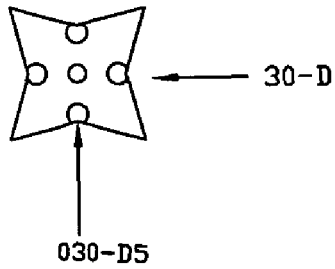
FIG. 8 is an illustration of a thumb wheel according to the present invention, depicting another design option.
Figure 9:
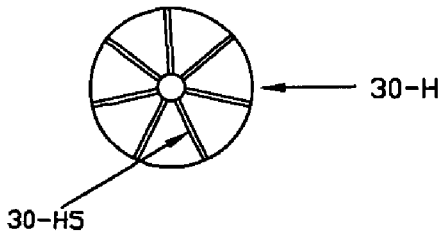
FIG. 9 is an illustration of a thumb wheel according to the present invention, depicting another design option.
Figure 10:
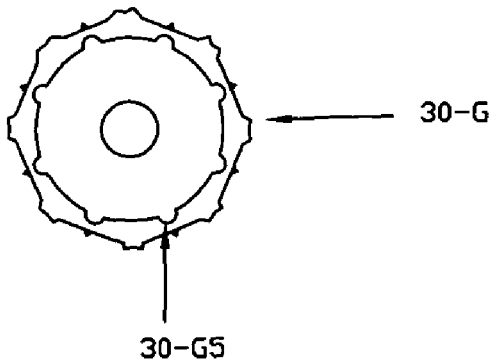
FIG. 10 is an illustration of a thumb wheel according to the present invention, depicting another design option.

FIG. 7 through 10 illustrate details concerning the typical mechanisms used for retaining positioning of rotary objects for those with limited knowledge in the mechanical arts. For example, Item 30-B6 in FIG. 7 is a protrusion by which the thumb wheel is centered, held and rotates. Item 30-B5 shows a notch by which the wheel is both turned due to the friction with a "thumb" and the alternating presence and non-presence of material to an opposing surface when the wheel is turned. FIG. 8 provides another example of an option in securing the wheel (30-D1) in position by installing a protrusion or depression in the location marked by 30-D5. A similar mechanism is provided in FIG. 9, where item 30-H has a protrusion or depression from the center protrusion to the outer surface of the wheel, as shown by 30-H5. FIG. 10 depicts another means of turning of the wheel 30-G6 and turn limiting protrusions 30-G5.

Figure 11A:
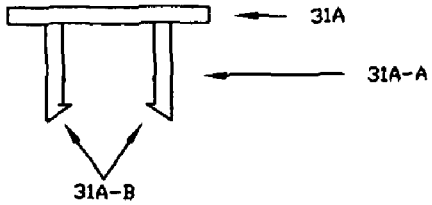
FIG. 11A is front-view illustration of a retaining clip according to the present invention.
Figure 11B:
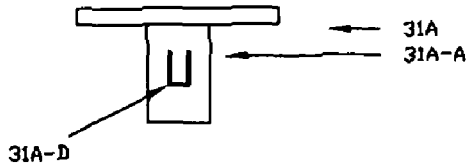
FIG. 11B is a side-view illustration of the retainer clip.
Figure 11C:
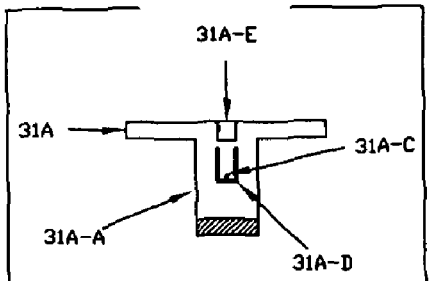
FIG. 11C is a cross-sectional internal view of FIG. 11B.
Figure 11D:
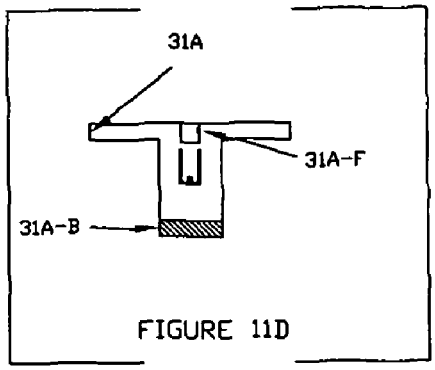
FIG. 11D is a cross-sectional internal view of FIG. 11B, taken from an opposite side of that of FIG. 11C.
Figure 11E:
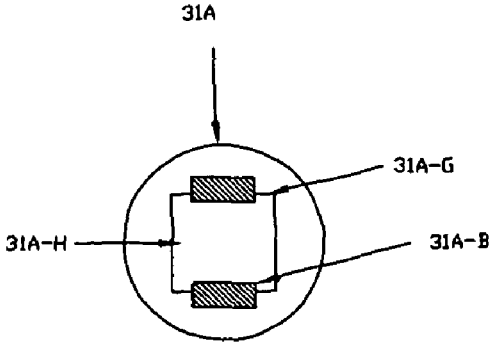
FIG. 11E is a bottom-view illustration of the retaining clip depicted in FIG. 11A.
Figure 11F:
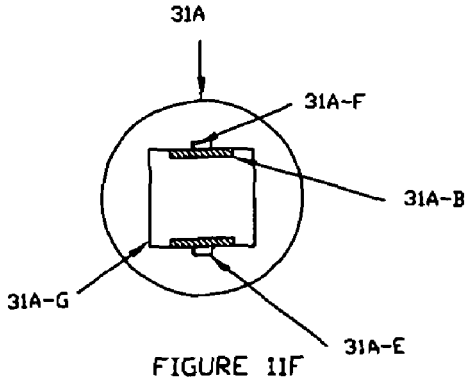
FIG. 11F is a top-view illustration of the retaining clip depicted in FIG. 11A.
Figure 12A:
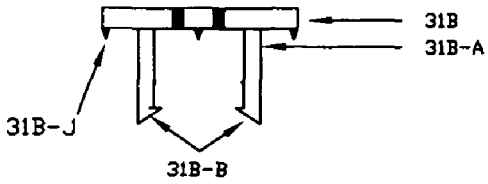
FIG. 12A is front-view illustration of an alternative retaining clip design according to the present invention.
Figure 12B:
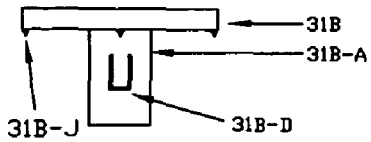
FIG. 12B is a side-view illustration of the retaining clip depicted in FIG. 12A.
Figure 12C:
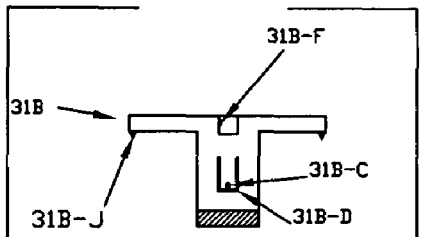
FIG. 12C is a cross-sectional internal view of FIG. 12A.
Figure 12D:
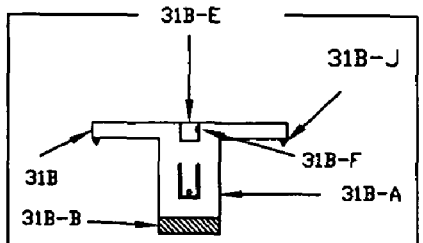
FIG. 12D is a cross-sectional internal view of FIG. 12A, taken from an opposite side of that of FIG. 12C.
Figure 12E:
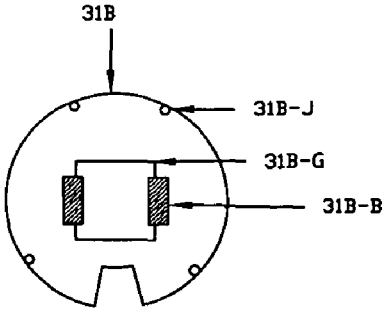
FIG. 12E is a bottom-view illustration of the retaining clip depicted in FIG. 12A.
Figure 12F:
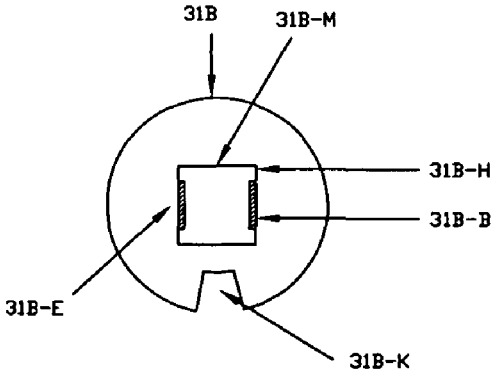
FIG. 12F is a top-view illustration of the retaining clip depicted in FIG. 12A.

FIGS. 11A through 11F provide insight into the operational requirements of the retaining clip, model 31A, in general. For example, FIG. 11A shows the top surface of the retaining clip 31A, which provides a surface for the slider to be retained. For example, the slider can be retained by means of the legs 31A-A, which can protrude into the cap or lid and then catch (via a catch 31A-B) in a position where it is not easily released. FIG. 11B provides a view of some cases where an additional flexible portion of the leg 31A-A is freed from the rest of the retaining clip so that it can operate with minimal disruption to the retaining portion 31A-D of the retaining clip 31A. FIG. 11C provides a view from the center of the retaining clip 31A and outwards. When viewed from this location, additional aspects are reveled. A slot for the insertion of part 30 is shown by 31A-E. Protrusion or depression 31A-D controls rotational movement of the thumb wheel 30 when items are assembled. In addition, the protrusion of the thumb wheel 30 is at times retained within the unit 31A, by stops placed in strategic locations. FIG. 11D shows a view 180 degrees from FIG. 11C to demonstrate that dependent on the size, flexibility and design chosen, it may be necessary to provide redundant stops and retainers on both sides of the internal space. FIG. 11E provides a bottom-view where the hatched surface 31A-B is shown and the opening 31A-H for the thumb wheel 30 is illustrated. 31A-G is the physical opening area that is depicted in this illustration as a square. This opening may change dependant on the thumb wheel chosen. FIG. 11F provides a top-view illustration, depicting the items previously described in FIGS. 11A through 11D.

FIGS. 12A through 12F illustrate an alternative design of the present invention. All design features are identical (to that described above with respect to FIGS. 11A through 11F, with the addition of a notch 31B-K for viewing a section of a slider below the retaining clip 31B and slider positioning protrusions 31B-J. The viewing notch is clearly observable in FIGS. 12A, 12E, and 12F. The positioning items are shown as protrusions for clarity and are well known by those in the mechanical arts. Additionally, as clearly understood by one skilled in the art, the protrusions can be transitioned to depressions to accomplish identical objectives. These positioning protrusions may also be arranged in any configuration that allows the slider selected to be held where required for reading of the time duration. These positioning protrusions are visible in FIGS. 12A thru 12E.

Figure 13A:
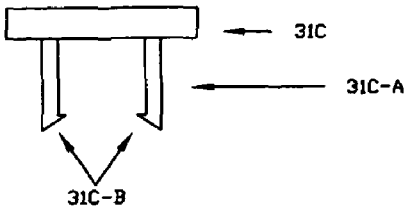
FIG. 13A is front-view illustration of yet another alternative retaining clip design according to the present invention.
Figure 13B:
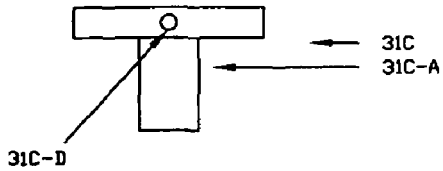
FIG. 13B is a side-view illustration of the retaining clip depicted in FIG. 13A.
Figure 13C:
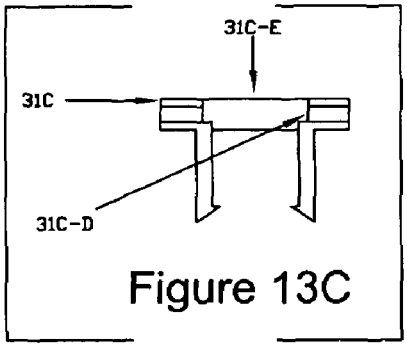
FIG. 13C is a cross-sectional internal view of FIG. 13A.
Figure 13D:
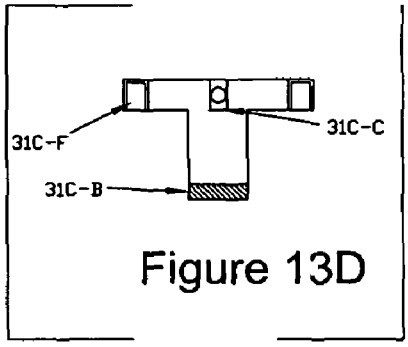
FIG. 13D is a cross-sectional internal view of FIG. 13B.
Figure 13E:
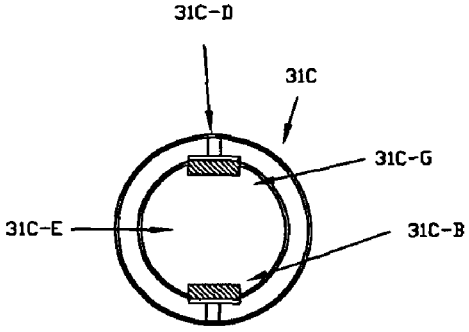
FIG. 13E is a bottom-view illustration of the retaining clip depicted in FIG. 13A.
Figure 13F:
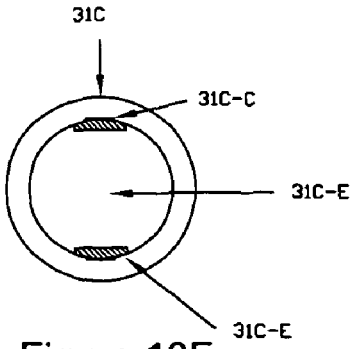
FIG. 13F is a top-view illustration of the retaining clip depicted in FIG. 13A.

FIGS. 13A through 13F provide a third mechanism for accomplishing the same task as illustrated in FIGS. 11A through 12F. FIG. 13A is an elevation or side view of the third retaining clip 31C design. The retaining tab locations 31C-B are facing inward rather than outward on this model. The use and orientation of these tabs are well known by those in the mechanical arts, and may be used on both earlier models also. All of the changes shown in FIGS. 13A through 13F may be equally shared with the previous models as known by those in the mechanical arts. This figure also indicates that no positioning tabs are installed in this retaining clip. FIG. 13B shows a cylindrical hole 31C-D through the retaining clip 31C on a horizontal plane. In this retaining clip design, the thumb wheel protrusion is inserted into the cylindrical hole 31C-D to maintain its position in the retaining clip 31C for spinning. FIGS. 13C and 13D provide views from the center of the retaining clip 31C and outwards. When viewed from this location, additional aspects are reveled. A slot for the insertion of part 30 is shown by 31C-D. FIG. 13D shows the hollow top support structure as indicated by 31C-F. A symbolic notation is made by 31C-C as the clearances required by the insertion of the thumb wheel 30 into the retaining clip 31C in this design are directly related to the tolerances and size of the unit. FIG. 13E provides a bottom view of the retaining clip indicating a circular opening (31C-E) to receive the thumb wheel 30, while FIG. 13F is a top-view of this retaining clip 31C.

Figure 14A:
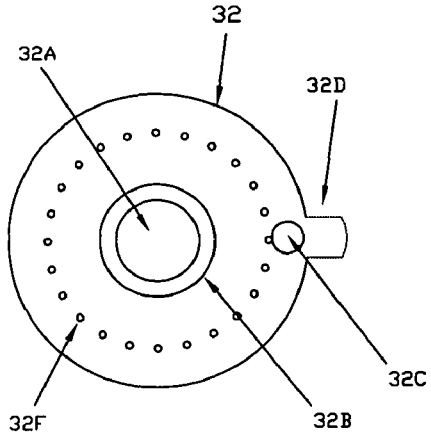
FIG. 14A is a top-view illustration of a slider according to the present invention.
Figure 14B:
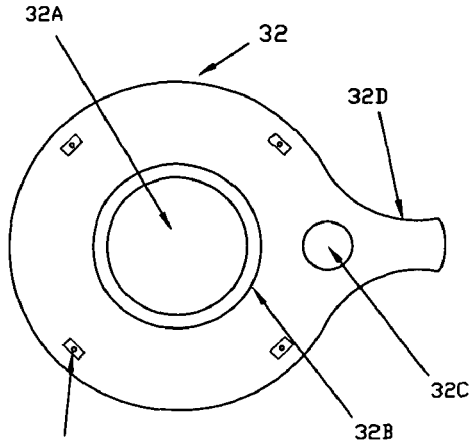
FIG. 14B is a top-view illustration of an alternative slider design according to the present invention.
Figure 14C:
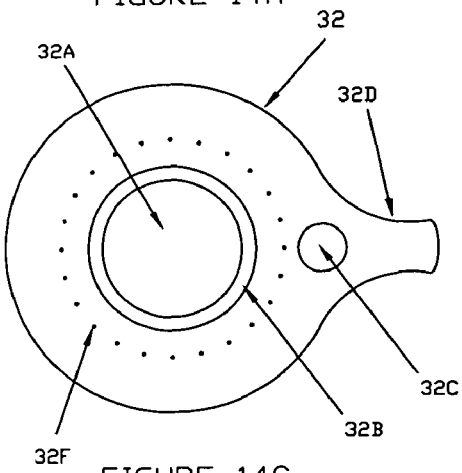
FIG. 14C is a top-view illustration of an alternative slider design according to the present invention.
Figure 14D:
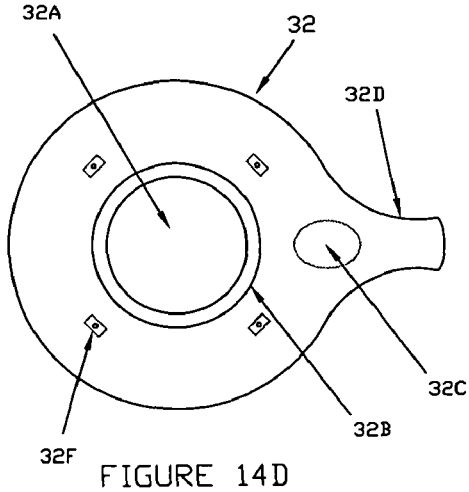
FIG. 14D is a top-view illustration of an alternative slider design according to the present invention.
Figure 14E:
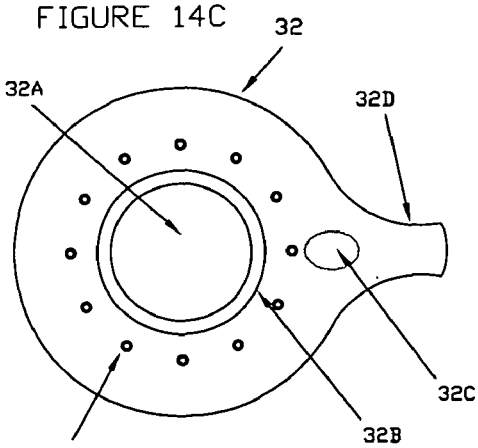
FIG. 14E is a top-view illustration of an alternative slider design according to the present invention.
Figure 14F:
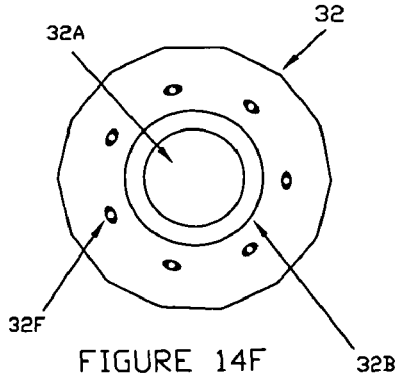
FIG. 14F is a top-view illustration of an alternative slider design according to the present invention.
Figure 14G:
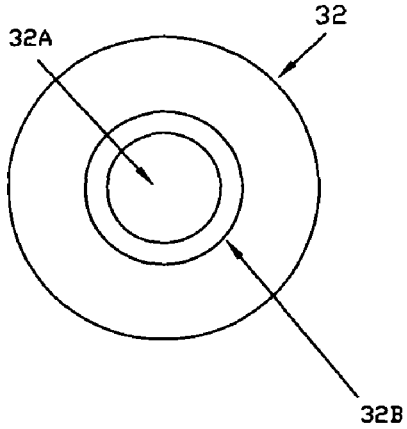
FIG. 14G is a top-view illustration of a slider according to the present invention.
Figure 14H:
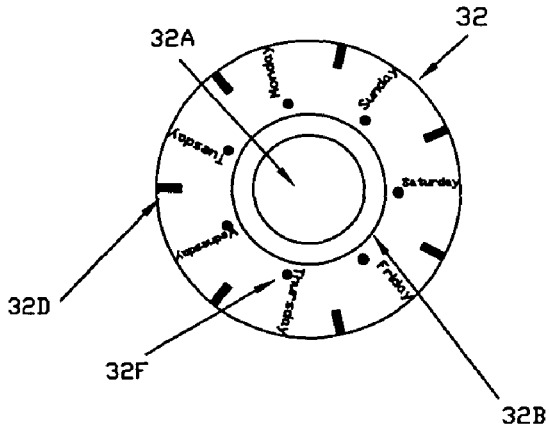
FIG. 14H is a top-view illustration of an alternative slider design according to the present invention.
Figure 14J:
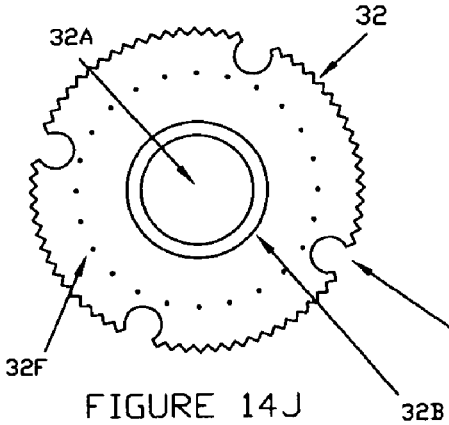
FIG. 14J is a top-view illustration of an alternative slider design according to the present invention.
Figure 14K:
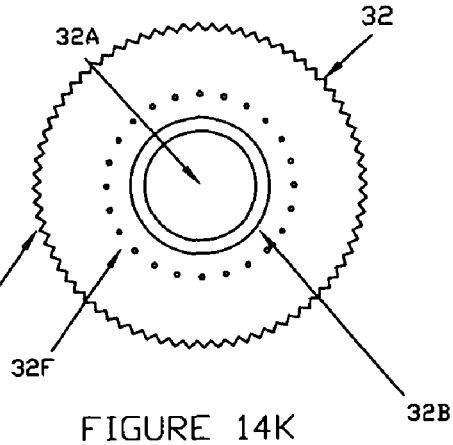
FIG. 14K is a top-view illustration of an alternative slider design according to the present invention.
Figure 14M:
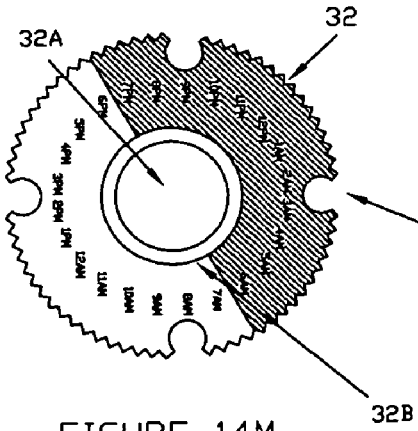
FIG. 14M is a top-view illustration of an alternative slider design according to the present invention.
Figure 14N:
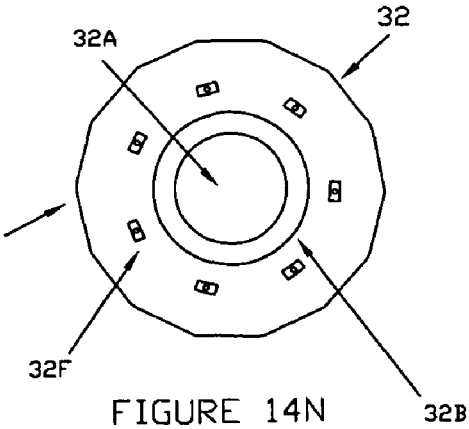
FIG. 14N is a top-view illustration of an alternative slider design according to the present invention.

FIG. 14A through 14F provide various design options for sliders 32 that may be used in the device. As is well known by those in the mechanical arts, the options may vary greatly. FIG. 14A illustrates constants among the sliders 32. For example, a cylindrical hole 32A is placed in the slider 32 for placement on the bottle or lid cap. A ring 32B is also included for retention below the retaining clip 31. The ring 32B may or may not protrude out from the main surface of the slider 32 as is well known by those in the mechanical arts. A protrusion 32F or depression for securing the slider from time period to time period is required on at least one side of the slider. Optional items that are used in some models are vision port holes 32C through which time durations can be tracked (i.e., viewed). Additionally, tabs 32D for turning the slider are also frequently required.

FIGS. 14G through N illustrate additional examples of sliders as can be understood by one skilled in the art. The descriptive markings and numerals used in FIGS. 14G through 14N are identical to those used in FIGS. 14A through 14F and remain for the readers reference.

Figure 15A:
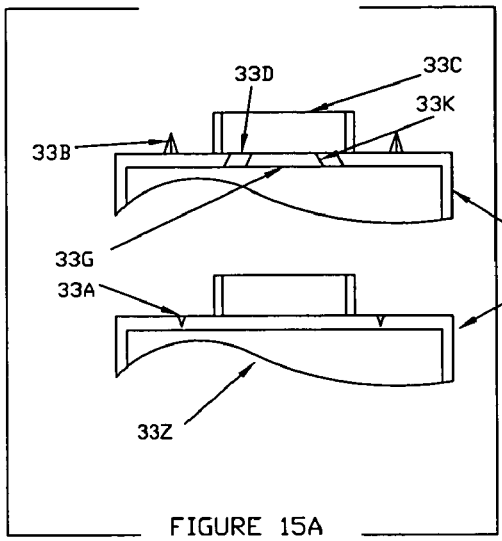
FIG. 15A is an internal, side-view illustration of a modified lid according to the present invention.

FIGS. 15A through 15D provided cross-sectional, exploded views of the modified cap or lid and the mated 180 degree view. For example, FIG. 15A shows the retaining clip tab (e.g., 31A-B, 31B, 31C-B of FIGS. 11A through 13F) catch location 33D and slider rotational centerpiece location 33C. Retaining position protrusions 33B or deviations 33A are also illustrated. A non-descript lower portion of this bottle cap has been indicated by 33Z. This invention can be placed on top of most commonly used containers in the industry with differing modifications.

Figure 15B:
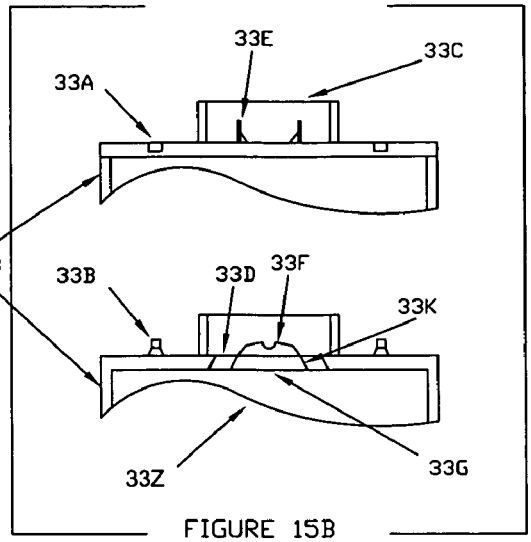
FIG. 15B is an internal, side-view illustration of another design of the modified lid according to the present invention.

FIG. 15B provides additional structure intended for use with designs such as 31C and 30G, in conjunction with 33F and 33E. Slots 33D have been reoriented for the difference in retaining clip 31C. The angles illustrated in 33K are dependant on the materials used, flexibility, methods and accuracy, indicating that the angled cut may not be necessary if proper positioning of the retaining tabs (e.g., 31A-B) are located properly within the design.

Figure 15C:
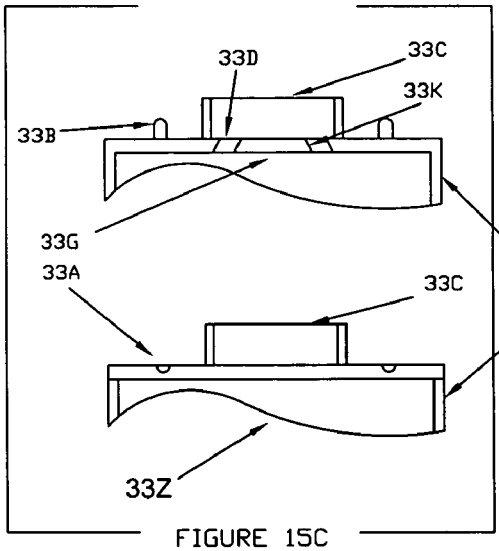
FIG. 15C is an internal, side-view illustration of another design of the modified lid according to the present invention.

Items 33A and 33B also changes throughout the designs of FIGS. 15A, B, C, and D. For example, FIG. 15C illustrates the protrusions 33B and deviations 33C as rounded items. As can be appreciated by one skilled in the art, the shapes of corresponding protrusions and deviations of the surfaces of the materials are well known within the mechanical arts and therefore a non-specific item within this design.

Figure 15D:
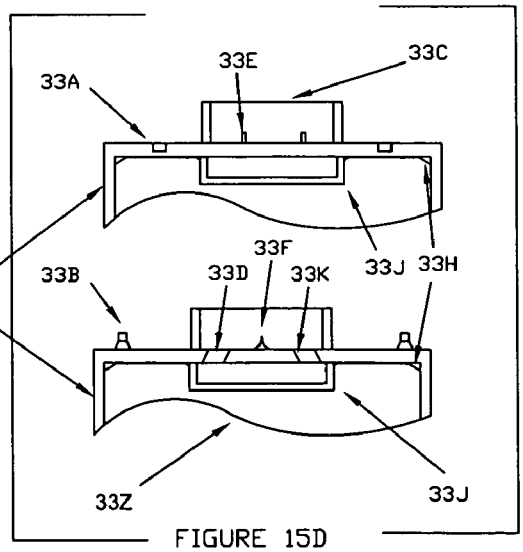
FIG. 15D is an internal, side-view illustration of another design of the modified lid according to the present invention.

FIG. 15D provides additional options for use of items described herein. Item 33F and different view 33E will allow for the use of the thumb wheels depicted in FIGS. 6A, 6B, 6C and 6F with retaining cap 31C. Alternate methods of maintaining a seal for the bottle or container cap is provided by 33J. An additional washer or seal is provided in 33H.

Figure 16A:
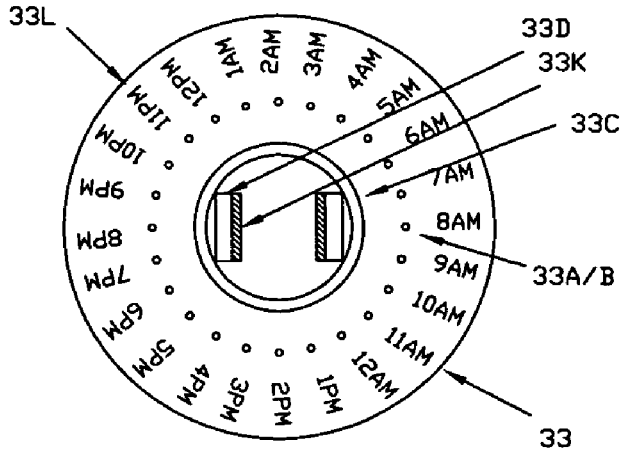
FIG. 16A is a top-view illustration of a modified lid according to the present invention.

For further illustration, FIG. 16A provides a top-view illustration of the slider with all additional items removed. Protrusions or deviations (33A/B) and time notations (33L) are clear. Ring 33C is observed as are the slots for the retaining clip 33D. Surface angle changes 33K are noted if required.

Figure 16B:
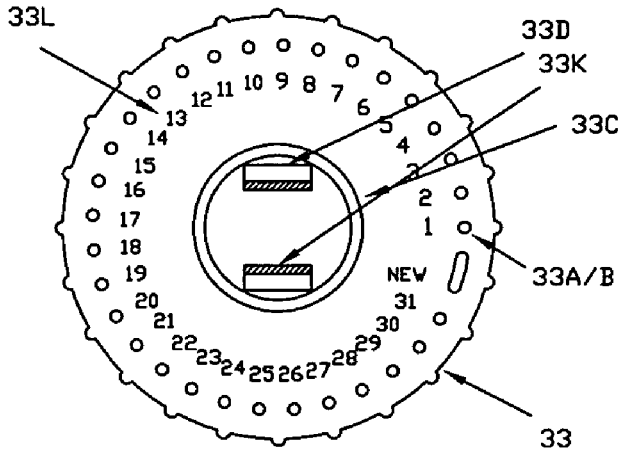
FIG. 16B is a top-view illustration of another design of the modified lid according to the present invention.

FIG. 16B is a variant in that the time indicated is now days of the month rather than an hourly time, and the deviations are not fully symmetrical for this application.

Figure 16C:
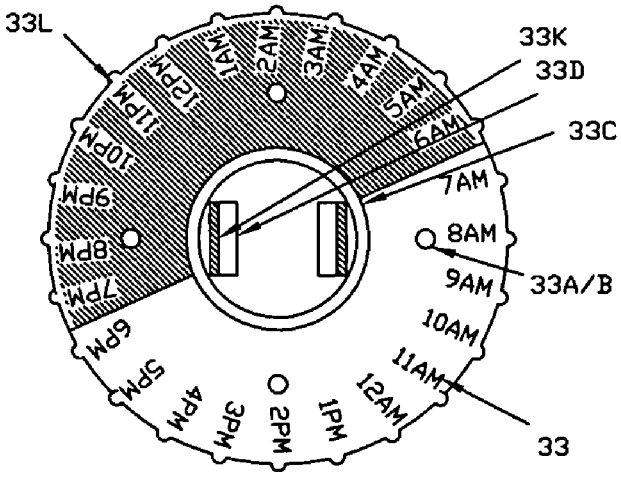
FIG. 16C is a top-view illustration of another design of the modified lid according to the present invention.

Additionally, FIG. 16C changes the post or deviation count and provides shading for day and night clarity.

Figure 17A:
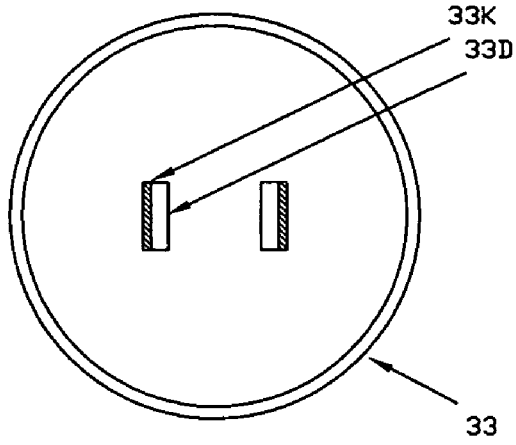
FIG. 17A is a bottom-view illustration of a modified lid according to the present invention.
Figure 17B:
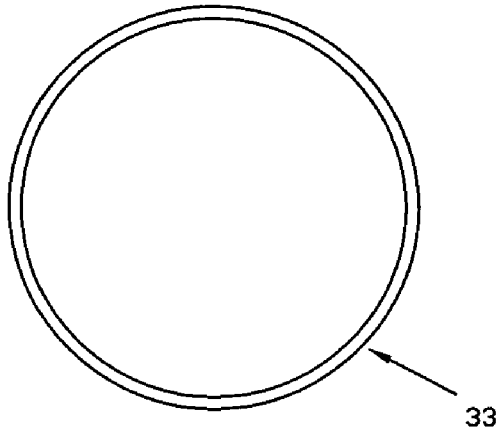
FIG. 17B is a bottom-view illustration of another design of the modified lid according to the present invention.
Figure 17C:
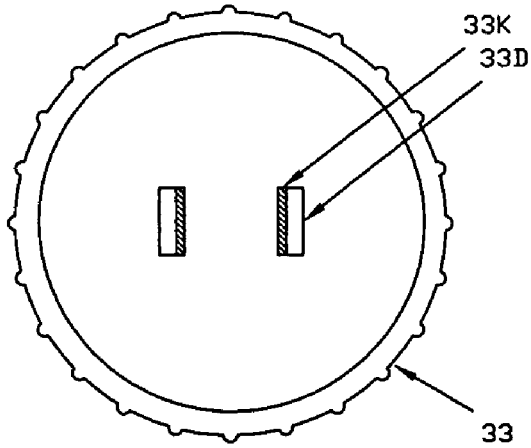
FIG. 17C is a bottom-view illustration of another design of the modified lid according to the present invention.

FIG. 17A provides a bottom-view illustration of the lid or cap. Penetrations and angled surfaces are shown if required. FIG. 17B shows a configuration that did not penetrate the bottom surface of the cap. FIG. 17C provides yet another example of a modified lid or cap.

For further understanding, FIGS. 18A and 18B provide an illustration of a nearly fully assembled device, from an internal side-view to an internal front-view of the operational parts of the invention. These two views provide insight to the device depicted in FIGS. 3A through 3C.

Additionally, FIGS. 19A and 19B provide an illustration of a nearly fully assembled device, from an internal side-view to an internal front-view of the operational parts of the invention. These two views provide insight to the device depicted in FIGS. 4A through 4C.

Finally, FIGS. 20A and 20B provide an illustration of a nearly fully assembled device, from an internal side-view to an internal front-view of the operational parts of the invention. These two views provide insight to the device depicted in FIGS. 5A through 5C.

It should be noted that although each element depicted in each figure may not be specifically described with respect to a particular figure, the use of each element is consistent throughout and is intended to be applied throughout the figures wherever each element may be present.

What is claimed is:

1. A manual prescription use recording device, comprising:

a lid for connection with a prescription container;

a slider rotatably connected with the lid, the slider being rotatable around the lid to reveal a first set of markings that are indicative of at least one of a time and date;

a thumb wheel that is rotatably attached with the lid such that the thumb wheel can be rotated to reveal a marking indicative of at least one of a time and date, wherein the slider is rotatable on an X-axis and the thumb wheel is rotatable on a Y-axis; and wherein the thumb wheel is attached with the lid such that the slider rotates around the thumb wheel, thereby allowing a user to log the time and date a medication was last taken by using the slider and thumb wheel attached with the lid of the prescription container.

2. The device as set forth in claim 1, further comprising a second slider rotatably connected with the lid, the second slider being rotatable around the lid to reveal a third set of markings that are indicative of at least one of a time and date.

3. The device as set forth in claim 1, further comprising protrusions and corresponding deviations formed in at least one of the lid and slider to maintain the slider in a desired position.

* * * * *